United States Patent [19]

Hart

[11] 4,219,982

[45] Sep. 2, 1980

[54] BUILDING ELEMENT

[75] Inventor: Michael G. Hart, Rochester, England

[73] Assignee: Relocator AG, Zug, Switzerland

[21] Appl. No.: 948,793

[22] Filed: Oct. 5, 1978

[30] Foreign Application Priority Data

Dec. 15, 1977 [CH] Switzerland ..... 15429/77

[51] Int. Cl.[2] ..... E04B 1/32

[52] U.S. Cl. ..... 52/641; 52/645

[58] Field of Search ..... 52/640, 641, 645, 66, 52/69, 71, 745, 646

[56] References Cited

U.S. PATENT DOCUMENTS

| | | | |
|---|---|---|---|
| 3,296,752 | 1/1967 | Philp | 52/640 X |
| 3,494,092 | 2/1970 | Johnson et al. | 52/122 X |
| 3,785,108 | 1/1974 | Satchell | 52/645 |
| 3,968,618 | 7/1976 | Johnson | 52/69 X |

FOREIGN PATENT DOCUMENTS

| | | | |
|---|---|---|---|
| 2307924 | 11/1976 | France | 52/69 |

*Primary Examiner*—Price C. Faw, Jr.
*Assistant Examiner*—Carl D. Friedman
*Attorney, Agent, or Firm*—Toren, McGeady and Stanger

[57] ABSTRACT

A simplified building element which may be remotely prefabricated for use in on-site building construction includes a rafter beam and a support post which are slidably interconnected by a link element and which are capable of being stored and transported to a building site in a collapsed juxtaposition in a generally parallel orientation with one end of the support post being slidable along the length of the rafter beam during on-site construction of a building to raise the rafter beam above the support post while the support post is placed in a vertical orientation.

9 Claims, 8 Drawing Figures

BUILDING ELEMENT

BACKGROUND OF THE INVENTION

The present invention relates generally to building construction, and more particularly to prefabricated construction elements capable of use for on-site erection. This invention also relates to a method of erecting at least two such elements to form a building section and a building composed of such elements.

The simplest buildings are usually those erected in the form of hangar construction. This form of construction usually enables large spaces to be enclosed, with little or no sub-divisions. Such buildings may be erected with relatively low expenditure of material and time. This is particularly advantageous if the buildings are for use in industry, for agricultural purposes or for permanent exhibitions.

Normally, hungar construction makes use of a plurality of plane frames or trusses, which are combined to form a stable three-dimensional frame. The three-dimensional frame is then clad with gable and longitudinal walls and a roof.

In carrying out this form of building, the individual parts are generally prepared or prefabricated in a factory, transported to the construction site and there assembled by specialists using suitable machines and tools to form the supporting structure.

The present invention is directed toward development of an improved method of construction for hangar-type buildings. The invention is intended to provide a building element which can be economically manufactured to various dimensions and which can be erected on site with semi-skilled labor and with minimum tools and equipment. Furthermore, the invention is intended to enable, where necessary, dismantling of a building with relative ease and simplicity, and subsequent use of the dismantled building elements at another location.

SUMMARY OF THE INVENTION

Briefly, the present invention may be described as providing a building element comprising two spaced parallel support posts connected together by bracing means, two parallel rafters secured together in spaced relationship corresponding to the spacing of the support posts and associated one with each support post and connecting means or slidable linking elements connecting each support post to the associated rafter, with the direction of length of the support post and the associated rafter substantially in a common plane, the connecting means being slidable in the direction of length of the associated rafter and permitting pivotal movement of the associated support post relative thereto in the common plane.

Preferably, the connecting means comprises a link pivotally attached to the associated support post and a roller attached to the link and rotatably supported by the associated rafter for displacement lengthwise thereof.

With advantage, the rafter has a longitudinally extending guide rail operable to guide the longitudinal displacement of the associated roller.

The invention also extends to a method of erecting a building section which comprises laying upon the ground two building elements formed as described above, with the rafters resting on the associated support posts and the ridge ends of the rafters of one building element in proximity to the ridge ends of the rafters of the other building element, raising the rafters until, under the action of their weight and that of the associated support posts they assume a predetermined inclined position relative to each other with the ridge ends abutting, fixing a ridge haunch to the ridge ends of each pair of abutting rafters to secure the rafters together in the predetermined inclined position, attaching an eaves haunch to the upper end of each support post, further raising the rafters and erecting the support posts to a substantially vertical position, securing each eaves haunch to the associated rafter to secure the associated support post thereto and securing the lower ends of the support posts in foundations.

The new building element can be fabricated in a works or factory and requires no further finishing on the site. To execute the preferred method of erecting a building section by means of such elements, semi-skilled labor can be employed. The sole, fairly large item of equipment which might be required is a lifting device, which is usually available on the majority of building sites. A building consisting of the new elements can, if required, be broken down again at little cost into its individual elements, with these elements being capable of use again a number of times at different locations.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1:
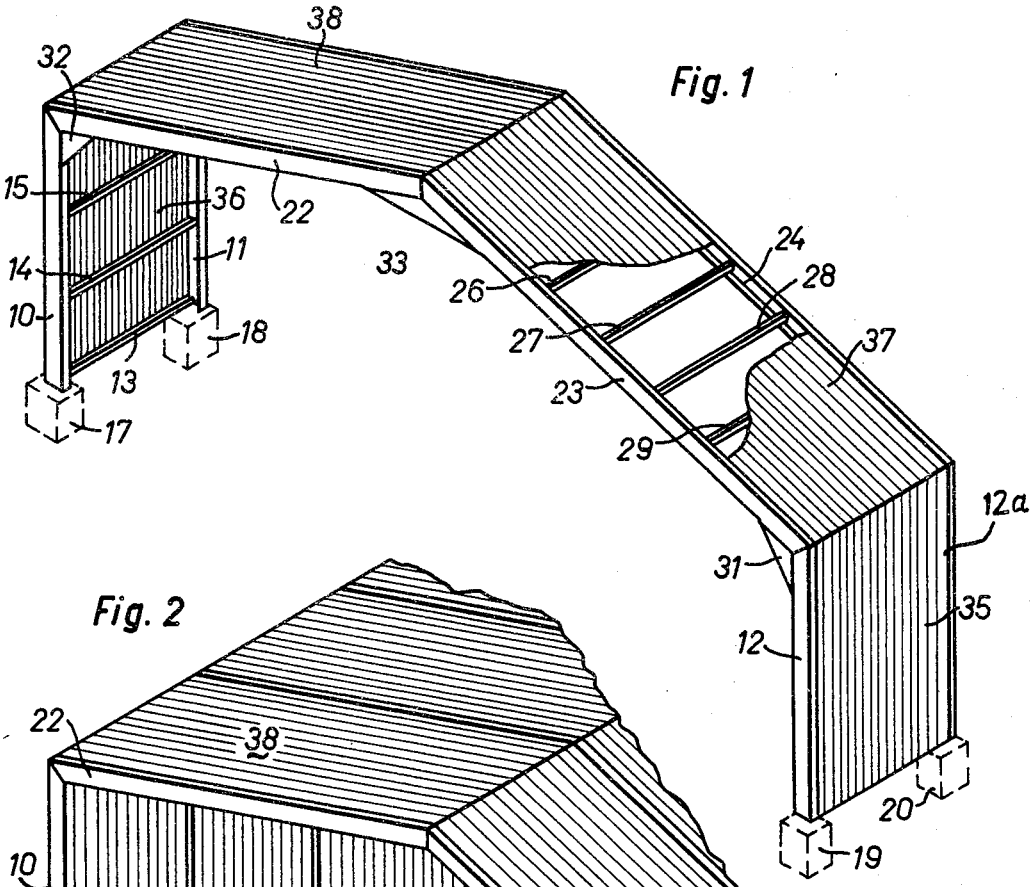
FIG. 1 is a perspective view of a building section consisting of two building elements.

Referring now to the drawings, wherein like reference characters refer to similar parts throughout the various figures thereof, there is shown in FIG. 1 a building section which contains two identical building elements, fixed together by ridge haunches. Each element contains two spaced parallel support posts 10 and 11 and 12 and 12*a*, respectively, which are fixed together by means of bracings of which bracings 13, 14 and 15 are shown connecting the posts 10 and 11. The lower ends of these support posts are designed to be inserted into foundation blocks 17, 18 and 18, 20, respectively (shown in broken line). The ends of rafters are supported on the upper ends of the support posts 10, 12 and 12*a*, the rafters 22, 23 and 24 associated with the support posts being visible in FIG. 1. The rafters are connected to each other rigidly by purlins, the purlins 26, 27, 28 and 29 connecting the rafters 23 and 24 being shown. Each rafter is fixed to the associated support post by means of an eaves haunch, of which only the eaves haunches 31 and 32, respectively, connecting the rafter 23 and post 12 and the rafter 22 and the post 10 can be seen in FIG. 1. The ridge ends of the abutting rafters are connected together by means of ridge haunches, of which only the ridge haunch 33 between the rafters 22 and 23 can be seen in FIG. 1. Each building element contains, at the connection point between its two support posts and the associated rafters, a further connecting device (not visible in FIG. 1) which will be described in detail with reference to FIGS. 3 and 4. The lateral wall between the support posts 10 and 11 and the lateral wall between the support posts 12 and 12*a*, and also the roof surface between the rafters is clad with a wall cladding and roof cladding denoted by the references 36, 35, 37 and 38.

Figure 2:
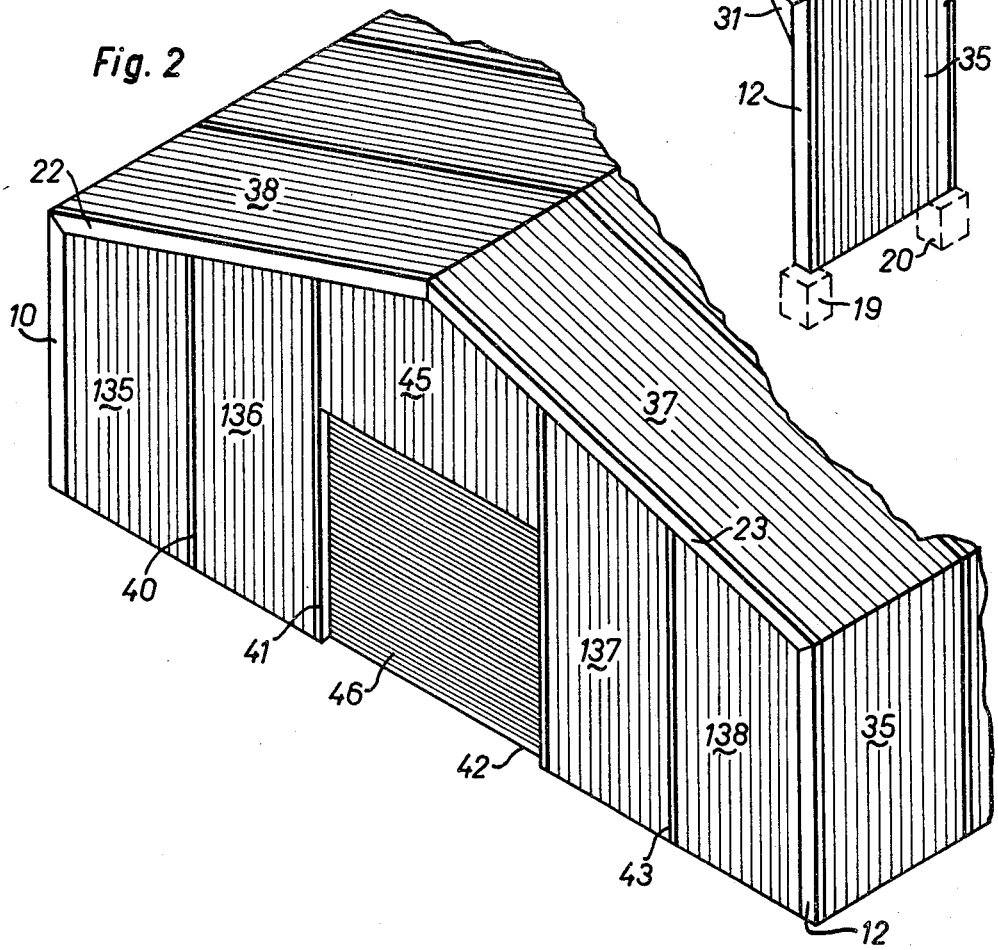
FIG. 2 is a perspective view of a gable end of a hangar constructed with the building elements of FIG. 1.

FIG. 2 shows the gable end of a hangar in which the support posts 10, 12 and the rafters 22 and 23 fixed thereto and also the wall cladding 35 and roof cladding 37, 38 can be seen. The rafters 22, 23 of the gable end are supported on gable wall posts 40, 41 and 42, 43, respectively. The lower ends of the gable wall posts are fixed to foundations (not shown). Gable wall cladding 135, 136, 137, 138 is mounted on and between the gable wall posts. The area between the two central gable wall posts 41, 42 is clad only in the upper region with wall cladding 45. The remaining lower opening is closed with a roller shutter door 46.

Figure 3:
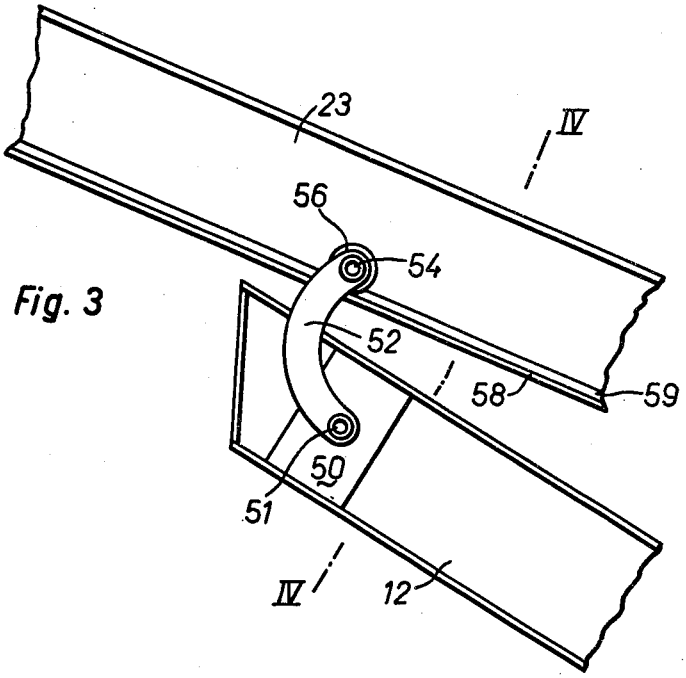
FIG. 3 is a lateral view of the upper end of a support post, of a part of a rafter and of the device used for connecting them together.

FIG. 3 shows a lateral view of the connecting device which is fixed to the upper end of each support post to simplify erecting of the building element and is disposed slidably in the longitudinal direction of the associated rafter. In FIG. 3, the support post 12 and associated rafter 23 are shown.

Figure 4:
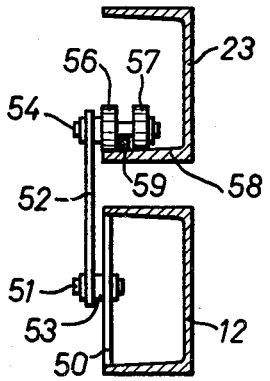
FIG. 4 is a section along the line IV—IV of FIG. 3.

FIG. 4 shows a section through the support post and rafter with a longitudinal view of the link connection. The link connection comprises a plate 50 which is welded to the support post 12. A hinge pin 51 is fixed to the plate. One end of a link 52 is pivotally mounted on the hinge pin 51. Between the plate 50 and the link 52, a sleeve 53 is pushed onto the hinge pin. This sleeve 53 serves as a spacer and is designed to prevent the link 52 from toughing the support post 12. At the other end of the link 52 a bearing pin 54 is fixed which is aligned substantially parallel to the hinge pin 51. Two freely rotatable rollers 56, 57 are journalled on the bearing pin. These rollers run on the inner face of the lower flange 58 of the channel-section rafter 23. A guide rail 59 is welded to the inner face of the flange 58. The guide rail is intended to provide lateral guidance for the rollers 56, 57 and prevents the rollers and connecting device from rolling sideways off the inner surface of the flange.

Figure 5A:
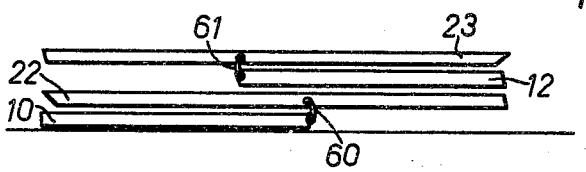
FIGS. 5*a* to 5*d* illustrate steps in the erection of the new building element.

As already described above, the new building elements may be fabricated in a works or factory remote from the building site. The elements can be transported individually or, as shown in FIG. 5*a*, assembled together in pairs. Each rafter rests upon the associated support post. Thus the rafter 22 rests on the support post 10, the rafter associated with the support post 11 rests on the latter, and the rafters 23 and 24 rest, respectively, on the support posts 12 and 12*a*. Each support post is connected to the associated rafter by means of a connecting device 60, 61.

Figure 5B:
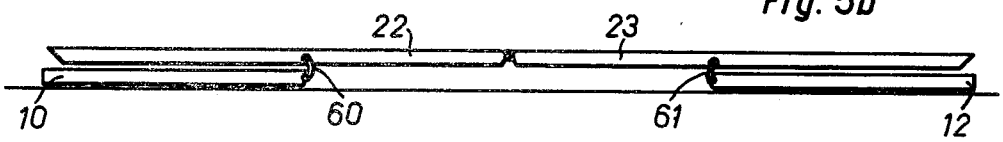
Figure 5C:
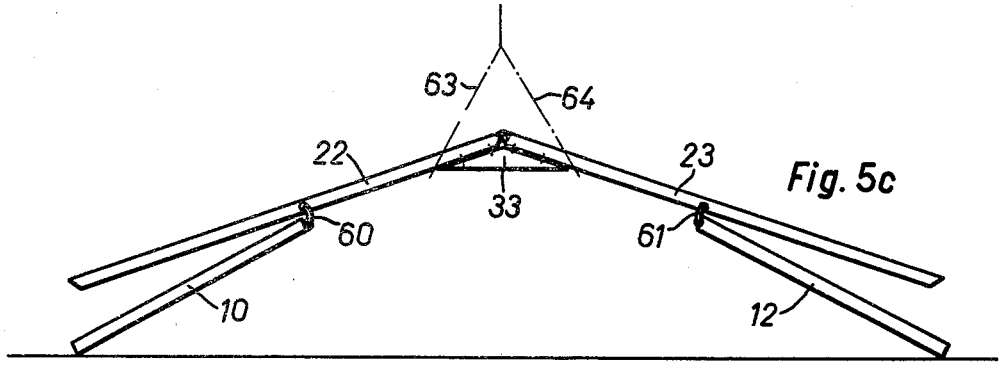
Figure 5D:
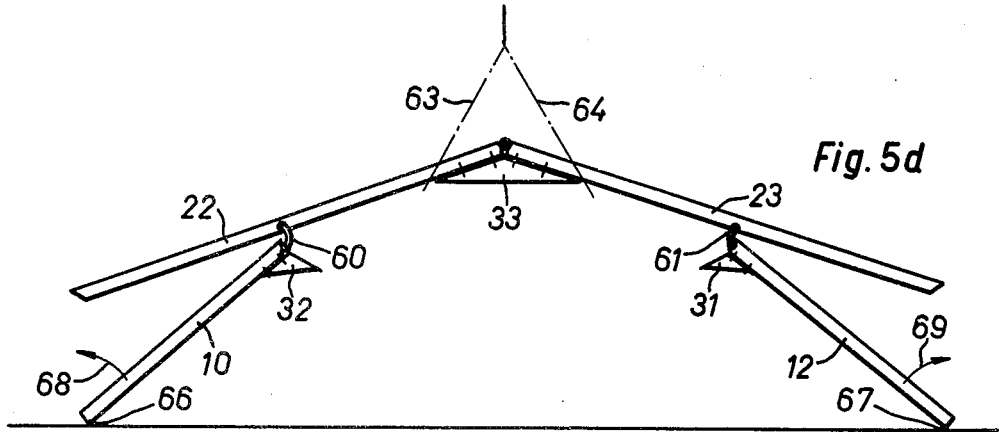

At the intended construction site, a pair of building elements are then laid on the prepared ground alongside each other, the ridge ends of the rafters abutting, as shown in FIG. 5*b*. The lifting cables 63, 64 of a lifting device (not shown) are then attached near the ridge ends of the rafters and the two building elements are slowly raised. As soon as the rafters have attained a predetermined inclined position, which corresponds practically to the slope of the roof of the building to be erected, a ridge haunch 33 is fitted to connect the rafters 22 and 23 firmly together (FIG. 5*c*). A similar ridge haunch (not shown) is used to connect the rafter 24 to that rafter associated with the support post 11. The eaves haunches 32, 31, respectively, are then fixed to the upper ends of the support posts 10, 12 (FIG. 5*d*) and similar eaves haunches (not shown) are attached to the upper ends of the support posts 11 and 12*a*.

As the building elements are further raised, the rafters remain in the angular position illustrated, determined by the ridge haunch 33. The support posts are pivoted practically about their lower bearing points 66, 67 in the direction of the arrows 68 and 69, the upper ends of the support posts being slid at the connecting device 60, 61 to the ends of the rafters which constitute the eaves. When the elements have been raised sufficiently far for the support posts 10, 12 to stand vertical, the eaves haunches are fixed to the adjacent associated rafters. The building section than has the form shown in FIG. 1, and the lower ends of the support posts can be placed on prepared foundations and fixed to them.

In order to erect a hangar, any desired number of the described building sections can be erected alongside one another and connected to one another. The gable wall posts 40, 41, 42, 43 shown in FIG. 2 are set upon foundations at their lower end and fixed to these foundations. The upper ends of the gable wall posts are fixed to the rafters.

It will be understood that a building of the type described can be dismantled equally simply if the above described operations are carried out in the reverse sequence, and that the individual building elements can be used again many times.

In a preferred form of embodiment of the new building elements, the materials used and the most important dimensions are in accordance with the British Standard Specifications and the Code of Practice. The load bearing components, that is to say the support posts and rafters, are preferably of channel-section (FIG. 4) and are made of Grade 43 steel. The gable wall posts, purlins and lateral wall bracings are of steel tube, and the ridge haunches and eaves haunches are of steel plate. For attaching the ridge haunch and eaves haunches to the rafters and support posts, high strength friction grip bolts with load indicator washers are used. For the connecting device, a guide rail and link and bearing pins of steel have proved satisfactory, in co-operation with nylon rollers. The cladding can be adapted to the anticipated conditions and in particular to the expected wind and weather conditions and can consist, for example, of galvanized corrugated steel sheet or plastics or aluminum. To provide thermal insulation, an inner cladding can additionally be used, consisting preferably of fibre insulation board, although practically any insulating material can be employed.

It will be understood that the described form of embodiment of the new building element, the method of erecting such elements and the building consisting of such elements can be varied both in regard to the form and dimensions and also in respect of the materials used and can be adapted to specific conditions. For example, windows can be incorporated in the wall cladding 35, 36 and skylights or ventilator openings in the roof cladding 37, 38. It is also possible, instead of the vertically opening and closing roller shutter door illustrated in FIG. 2, for a sliding door or a hinged swing door to be used. It is also possible for an I-beam to be used for the rafters. This section also enables the connecting device shown in FIGS. 3 and 4 to be modified in a manner which will be understood by any persons skilled in the art, with a roller running on the inner face of each of the two lower flanges of the I-beam. With this form of embodiment, the guide rail 59 can be dispensed with, because the vertical web of the I-beam fulfills the function of the guide rail.

While specific embodiments of the invention have been shown and described in detail to illustrate the application of the inventive principles, it will be understood that the invention may be embodied otherwise without departing from such principles.

What is claimed is:

1. A building element comprising two spaced parallel support posts and bracing means connecting said support posts, two parallel rafters secured together in spaced relationship corresponding to the spacing of the support posts and associated one with each support post and connecting means connecting each support post to the associated rafter, with the direction of length of the support post and the associated rafter substantially in a common plane, the connecting means being slidable in the direction of length of the associated rafter and permitting pivotal movement of the associated support post relative thereto in the common plane.

2. A building element according to claim 1 wherein said connecting means comprises a link pivotally attached to the associated support post and a roller attached to the link and rotatably supported by the associated rafter for displacement lengthwise thereof.

3. A building element according to claim 2 wherein said rafter has a longitudinally extending guide rail operable to guide the longitudinal displacement of the associated roller.

4. A building element according to claim 3 wherein said connecting means includes a further roller, the two rollers being disposed one on each side of the guide rail.

5. A building element according to claim 1 wherein the space between the two support posts is clad.

6. A building element according to claim 1 wherein the space between the two rafters is clad.

7. A construction element for use in the erection of a building and particularly adapted to provide support means for portions of the vertical side walls and a roof of said building, said element comprising at least a pair of spaced generally parallel support posts for supporting therebetween when in an erected condition a portion of the vertical side walls of an erected building, at least a pair of spaced generally parallel rafters for supporting therebetween when in an erected condition a portion of the roof of an erected building, and connecting means joining said support posts with said rafters with one end of each of said support posts in sliding engagement with said rafters, said connecting means operating to enable relative positioning of said rafters and support posts between a pre-erected position and an erected position, said rafters and support posts when in said pre-erected position being located to extend in a generally parallel juxtaposed orientation relative to each other, said rafters and said support posts being placed from said pre-erected position to said erected position by sliding movement of said one end of each of said support posts along the length of said rafters by operation of said connecting means to enable placement of said support posts in a generally vertical position with said rafters extending thereabove at an erection site during erection of the building.

8. A method for erecting a building comprising the steps of providing a support post and a rafter, said support post having one end in sliding engagement along the length of said rafter, sliding said one end of said support post along the length of said rafter to place said support post in a generally vertical position with said one end uppermost and with said rafter attached to said one end and extending therefrom, and forming said support post and said rafter as part of the support structure of a building to utilize said rafter as part of the supporting structure for the roof of said building and to utilize said support post as part of the supporting structure for a vertical wall of said building.

9. A building construction element comprising a first and a second longitudinal support member, and linking means slidably connecting one end of said first support member in sliding engagement along the length of said second support member, said linking means being configured to enable said first support member to be placed in a vertically extending position by pivoting of said first support member about the end thereof opposite said one end while said one end is moved in sliding engagement along the length of said second support member thereby to raise said second support member over said first support member and to place said first and second support members in position to form, respectively, part of the supporting structure for a wall and a roof of a building.

* * * * *